US012465163B2

(12) United States Patent
Bautz

(10) Patent No.: US 12,465,163 B2
(45) Date of Patent: Nov. 11, 2025

(54) HANGING NUMBERED CLOTHING WEAR COUNTING DIVIDERS

(71) Applicant: Joshua Francis Bautz, New York, NY (US)

(72) Inventor: Joshua Francis Bautz, New York, NY (US)

( * ) Notice: Subject to any disclaimer, the term of this patent is extended or adjusted under 35 U.S.C. 154(b) by 83 days.

(21) Appl. No.: 18/153,672

(22) Filed: Jan. 12, 2023

(65) Prior Publication Data

US 2024/0237840 A1 Jul. 18, 2024

(51) Int. Cl.
*A47G 25/14* (2006.01)

(52) U.S. Cl.
CPC ..... *A47G 25/1407* (2013.01); *A47G 25/1471* (2013.01)

(58) Field of Classification Search
CPC ..... A47G 25/1407; A47G 25/1471; A47G 25/1442
See application file for complete search history.

(56) References Cited

U.S. PATENT DOCUMENTS 1,422,973 A * 7/1922 Hertzberg ..... G09F 3/14 40/659
1,575,775 A * 3/1926 Lesser ..... A47G 25/1428 40/322
1,745,942 A * 2/1930 Miley ..... G09F 3/16 40/658
1,790,157 A * 1/1931 Kovary ..... G09F 3/00 40/667
2,288,071 A * 6/1942 Cohen ..... A47G 25/1421 40/658
4,886,010 A * 12/1989 Stutzman ..... G09F 11/23 116/318
5,174,537 A * 12/1992 Mazzorato ..... A47G 25/1421 248/340
5,499,466 A * 3/1996 House ..... A47G 25/1428 40/322
5,564,361 A * 10/1996 Satterwhite ..... G09F 11/23 116/323
6,330,969 B1 * 12/2001 Villaraut ..... G06M 1/083 235/375
7,246,730 B2 * 7/2007 Russo ..... A47G 25/1407 235/114
D630,444 S * 1/2011 Navarro ..... D6/315
8,069,595 B2 * 12/2011 Aiezza ..... G09F 3/14 40/322
8,424,231 B2 * 4/2013 Sliwa ..... G09F 3/06 40/662

(Continued)

*Primary Examiner* — F Griffin Hall

(57) ABSTRACT

A device that keeps count of the number of times hanging articles of clothing have been worn and the method of using the device. The device includes a set of sequentially numbered hanging dividers that keeps count of the number of times hanging articles of clothing have been worn. The device is to be used by selectively placing hanging articles of clothing in positions partitioned by the hanging numbered clothing wear counting dividers that indicate the number of times the respective hanging articles of clothing have been worn. The device provides quantitative information that can be used to determine when to clean hanging articles of clothing and provides an alternate method for the organization of hanging articles of clothing.

1 Claim, 6 Drawing Sheets

(56) References Cited

U.S. PATENT DOCUMENTS

| | | | | |
|---|---|---|---|---|
| 8,534,513 | B1 * | 9/2013 | Dixon | A47G 25/485<br>223/91 |
| 8,627,584 | B2 * | 1/2014 | Aiezza | G09F 3/14<br>40/322 |
| 9,339,135 | B2 * | 5/2016 | Terkanian | A47G 25/1471 |
| 9,480,354 | B2 * | 11/2016 | Eden | A47G 25/1407 |
| 9,867,487 | B2 * | 1/2018 | Kirkwood | A47G 25/1428 |
| 11,445,842 | B1 * | 9/2022 | Harshbarger | G09F 3/16 |
| 11,682,322 | B2 * | 6/2023 | Torgersen | G09F 11/23<br>283/48.1 |
| 11,829,840 | B2 * | 11/2023 | Luks | A47G 25/1428 |
| 2017/0238745 | A1 * | 8/2017 | Fikri | A47G 25/1471 |

* cited by examiner

HANGING NUMBERED CLOTHING WEAR COUNTING DIVIDERS

CROSS-REFERENCE TO RELATED APPLICATIONS

Not Applicable.

SEQUENCE LISTING

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

The present invention relates to a device and method that keeps count of the number of times hanging articles of clothing have been worn.

2. Description of Related Art Including Information Disclosed Under 37 CFR 1.97 and 1.98 (May Also be Called "Background Art")

Wearing and then subsequently cleaning articles of clothing is a common practice. Certain articles of clothing are cleaned after they have been worn one time (e.g., underwear, undershirts and socks); however, other articles of clothing may be cleaned after they have been worn numerous times (e.g., suits, dress shirts, jackets, blouses, dresses and pants). Hanging articles of clothing may fall into the category of articles of clothing that may be cleaned after they have been worn numerous times. If the number of times hanging articles of clothing have been worn are not counted then the hanging articles of clothing can be worn too many times and become dirty which can result in poor hygiene. Alternatively, hanging articles of clothing can also be worn too few times which can result in unnecessary expenses and resource use. Because of these issues, it is beneficial to keep count of the number of times certain hanging articles of clothing have been worn. This creates a clothing wear counting problem.

Despite the importance that society places on hygiene, regular methods are not always used to address this clothing wear counting problem. The methods that have been used to keep count of the number of times hanging articles of clothing have been worn include: (i) the use of memory; (ii) the use of senses (e.g., sight and smell); (iii) the use of log systems; and (iv) the use of other counting devices that attach to individual articles of clothing or their hangers. However, these methods do not easily solve the clothing wear counting problem in a practical way and include their own shortcomings.

Methods that rely on the use of memory are likely to be inconsistent because of the large number of hanging articles of clothing that wardrobes can contain and the sporadic manner in which cleaning can be conducted. The use of memory is made more difficult because of the long periods of time that can pass between when certain hanging articles of clothing are worn.

Methods that rely on the use of the sense of smell are likely to be inconsistent because scents can be difficult to detect in certain settings and may not reveal the cleanliness of the hanging articles of clothing. Methods that rely on the use of the sense of sight are likely to be inconsistent because the appearance of hanging articles of clothing may not reveal the cleanliness of the hanging articles of clothing.

Methods may also rely on the use of log systems to keep count of the number of times hanging articles of clothing have been worn. However, relying on log systems requires diligent effort in order to maintain the information which may not be desirable. Additionally, log systems do not display the number of times that hanging articles of clothing have been worn in a readily apparent manner.

Methods may also rely on the use of counting devices that attach to individual articles of clothing or their hangers. Examples of devices that attach to individual articles of clothing or their hangers include: Pub. Nos. US 2022/0253666A1 and US 2021/0358334A1; U.S. Pat. Nos. 9,601,037, 9,480,354, 9,380,902, 8,627,584, 8,069,595, 7,246,730, 6,330,969, 5,564,361, 5,499,466, 4,886,010, 3,124,284, 2,169,552, 1,381,881, D845,807 and D430,219. However, the devices that attach to individual articles of clothing or their hangers require the purchase of additional devices for each hanging article of clothing that is owned and subsequently purchased which can be burdensome to maintain.

Therefore, there is a need for a method or device that keeps count of the number of times hanging articles of clothing have been worn while addressing the issues discussed above. The present invention provides a unique solution for quickly and easily solving this clothing wear counting problem.

BRIEF SUMMARY OF THE INVENTION

The present invention relates to a device and method that keeps count of the number of times hanging articles of clothing have been worn. Keeping count of the number of times hanging articles of clothing have been worn provides quantitative information that can be used to determine when to clean the hanging articles of clothing and provides an alternate method for the organization of hanging articles of clothing.

The device is comprised of: (i) a set of multiple dividers; (ii) the dividers featuring a hook-like shape configuration that enables the dividers to be placed on closet hanger poles where hanging articles of clothing are placed; and (iii) the dividers featuring sequential numbering. The device functions as the basis for a method where hanging articles of clothing are placed in positions partitioned by the hanging numbered clothing wear counting dividers that indicate the number of times the respective hanging articles of clothing have been worn.

To use the device, the hanging numbered clothing wear counting dividers are placed on a closet hanger pole where hanging articles of clothing are placed. The hanging numbered clothing wear counting dividers are arranged in sequential order. The hanging articles of clothing are then selectively placed in certain positions partitioned by the hanging numbered clothing wear counting dividers.

The positions partitioned by the hanging numbered clothing wear counting dividers directly relate to the number of times the hanging articles of clothing have been worn as shown by the sequential numbering on the respective individual hanging numbered clothing wear counting dividers. For example, before a hanging article of clothing has been worn, its partitioned position is located on the outside of the set of hanging numbered clothing wear counting dividers before the individual hanging numbered clothing wear counting divider sequentially numbered 1; after a hanging article of clothing has been worn one time, its partitioned position is located after the individual hanging numbered clothing wear counting divider sequentially numbered 1; after a hanging article of clothing has been worn two times, its partitioned position is located after the individual hanging numbered clothing wear counting divider sequentially numbered 2; after a hanging article of clothing has been worn three times, its partitioned position is located after the individual hanging numbered clothing wear counting divider sequentially numbered 3; after a hanging article of clothing has been worn four times, its partitioned position is located after the individual hanging numbered clothing wear counting divider sequentially numbered 4; after a hanging article of clothing has been worn five times, its partitioned position is located after the individual hanging numbered clothing wear counting divider sequentially numbered 5; after a hanging article of clothing has been worn six or more times, its partitioned position is located on the outside of the set of hanging numbered clothing wear counting dividers after the individual hanging numbered clothing wear counting divider sequentially numbered 6.

Once hanging articles of clothing are placed in their respective positions partitioned by the hanging numbered clothing wear counting dividers, the method can be implemented and will keep count of the number of times the hanging articles of clothing have been worn.

In this method, after the hanging articles of clothing that were placed in the partitioned positions have been worn again, a decision is presented for the hanging articles of clothing to either: (i) be cleaned; or (ii) be selectively placed in new positions partitioned by the hanging numbered clothing wear counting dividers that indicate the number of times the respective hanging articles of clothing have been worn.

If hanging articles of clothing are cleaned then the method is repeated and the hanging articles of clothing are placed at the starting position partitioned for the hanging articles of clothing that have not been worn.

Alternatively, if hanging articles of clothing are selectively placed in new positions partitioned by the hanging numbered clothing wear counting dividers that indicates the number of times the respective hanging articles of clothing have been worn then they may be worn again at a later time. If the hanging articles of clothing are worn again at a later time, then the above discussed decision is presented again. As hanging articles of clothing have been worn an increasing number of times, the positions partitioned by the hanging numbered clothing wear counting dividers that indicate the number of times the respective hanging articles of clothing have been worn will similarly increase in number. As a result, the hanging articles of clothing will be placed in changing and increasing partitioned positions after each time they are worn until reaching the final position partitioned by the hanging numbered clothing wear counting dividers.

This method continues to keep count of the number of times hanging articles of clothing have been worn until they are cleaned, at which point, the method is repeated and the hanging articles of clothing are placed at the starting position partitioned for articles of clothing that have not been worn.

Since an unlimited number of hanging articles of clothing can be selectively placed in the partitioned positions, this method can keep count of the number of times an unlimited number of hanging articles of clothing have been worn simultaneously. As the method is circular, it can be repeated indefinitely.

The present invention solves numerous problems that exist with the currently available methods. The present invention is superior to relying on the use of memory and the use of senses because it provides quantitative information by utilizing a method that keeps count of the number of times hanging articles of clothing have been worn and is not dependent upon other qualitative variables. The present invention is superior to log systems because it does not require diligent effort in order to maintain the information and it displays the number of times that hanging articles of clothing have been worn in a readily apparent manner. The present invention is superior to counting devices that attach to individual articles of clothing or their hangers because the present invention does not require the purchase of additional items for each hanging article of clothing that is owned and subsequently purchased which can make it less burdensome to maintain. The present invention also provides an additional advantage over the currently available methods because it quickly and easily indicates the number of times an entire wardrobe of hanging articles of clothing have been worn.

The present invention can be made in a variety of ways. The present invention can be created using a variety of materials.

BRIEF DESCRIPTION OF THE SEVERAL VIEWS OF THE DRAWING(S)

Figure 5:
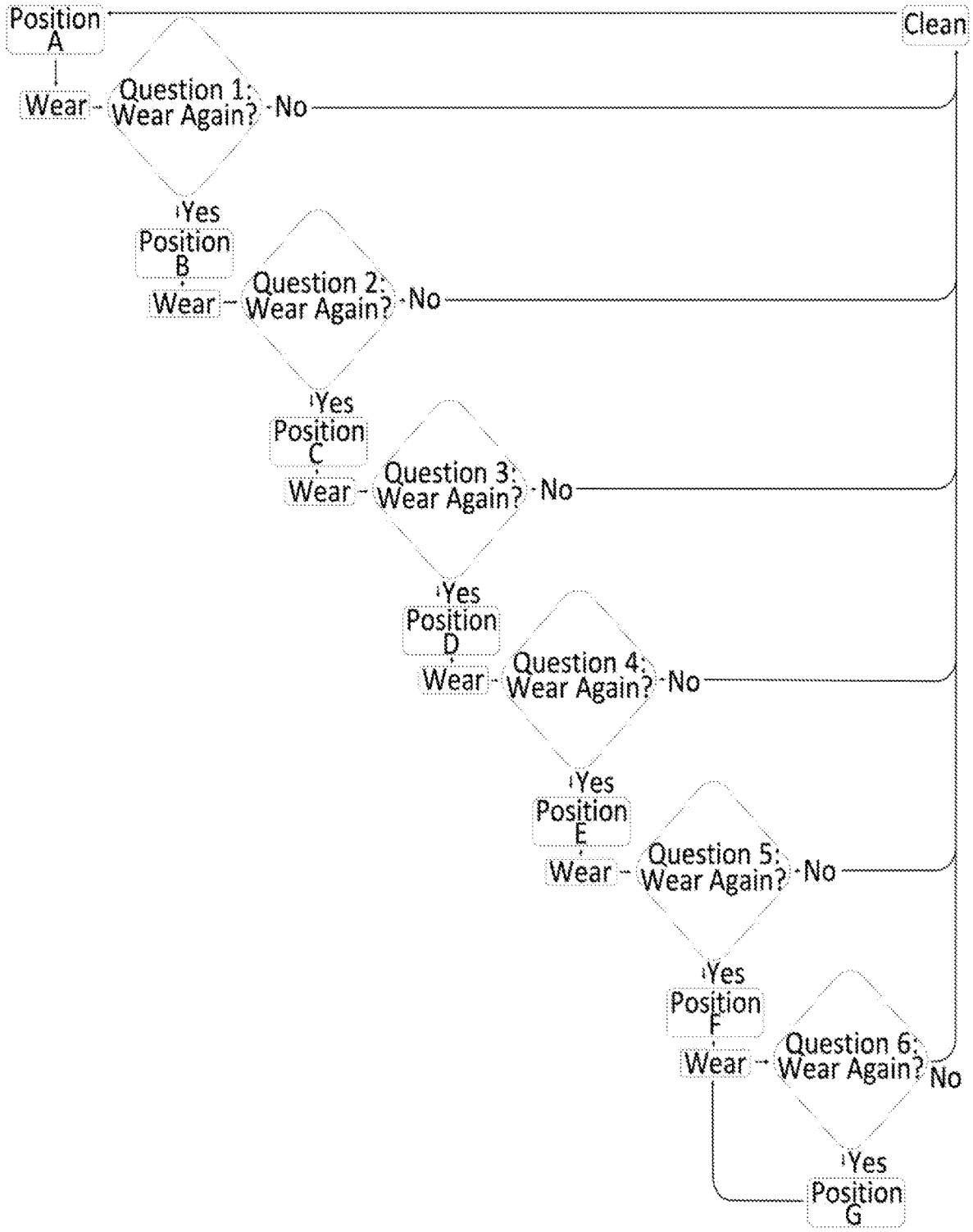
FIG. 5 depicts a flowchart illustration that shows the method that keeps count of the number of times hanging articles of clothing have been worn with the hanging numbered clothing wear counting dividers.
Figure 6:
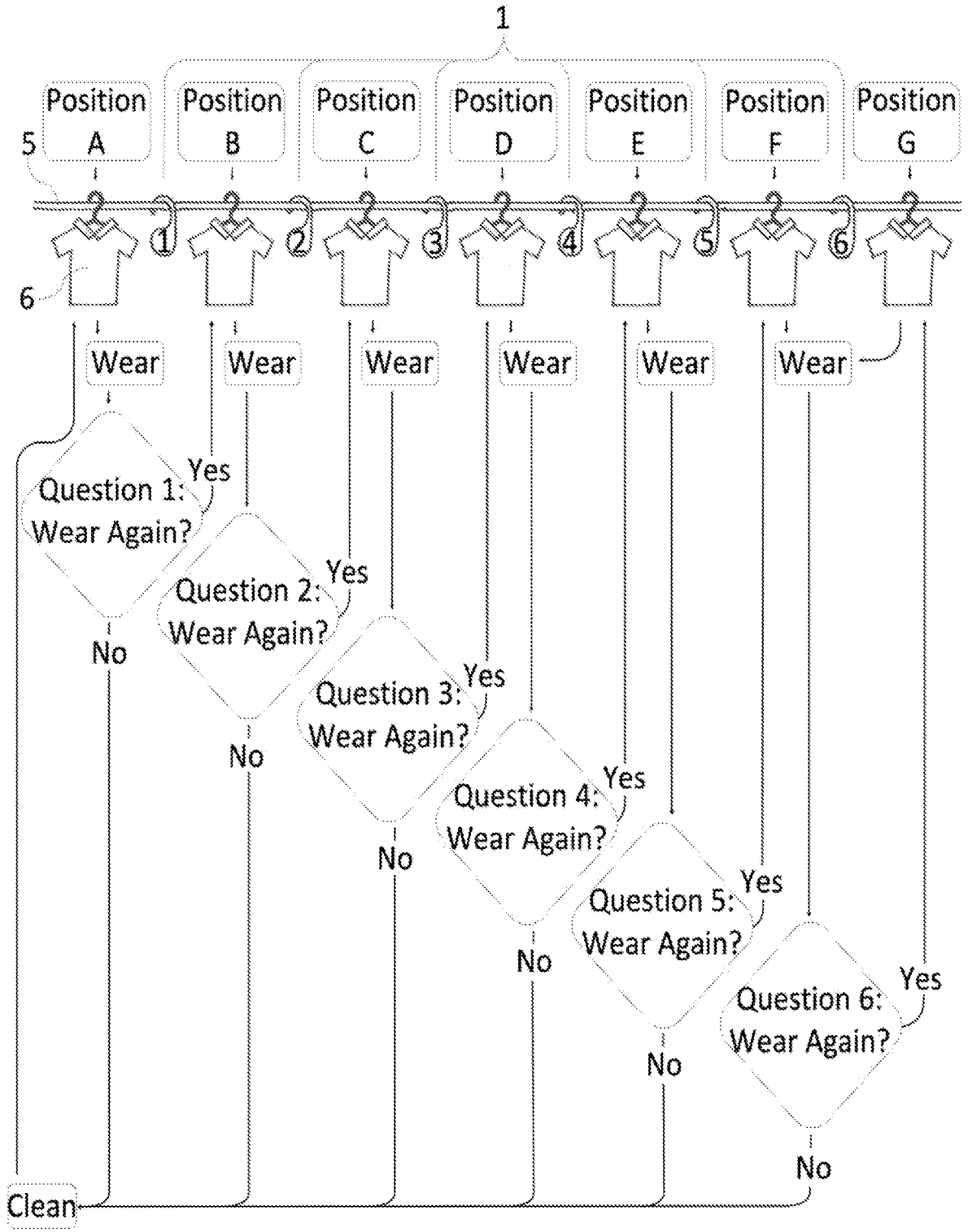
Figure 7:
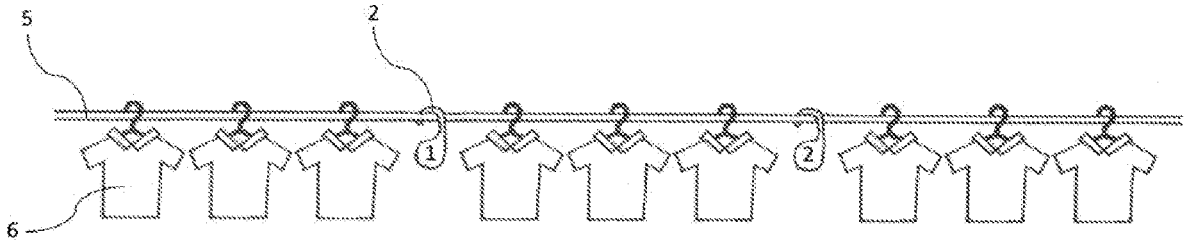

FIG. 6 depicts a visual representation of the flowchart illustration according to FIG. 5, which shows the method that keeps count of the number of times hanging articles of clothing have been worn with the hanging numbered clothing wear counting dividers; and FIG. 7 depicts a perspective view of numerous hanging articles of clothing selectively placed in partitioned positions by two individual hanging numbered clothing wear counting dividers arranged in sequential order on a closet hanger pole.

DETAILED DESCRIPTION OF THE INVENTION

The following drawings have been provided to assist with the understanding of the claims set forth within the specification. These drawings contain descriptive numbers and letters that identify elements of the device, aspects of the method of using the device, and other relevant objects, and are repeated throughout the figures. These drawings are not intended to be limiting as the present invention may be embodied in various ways.

Figure 1:
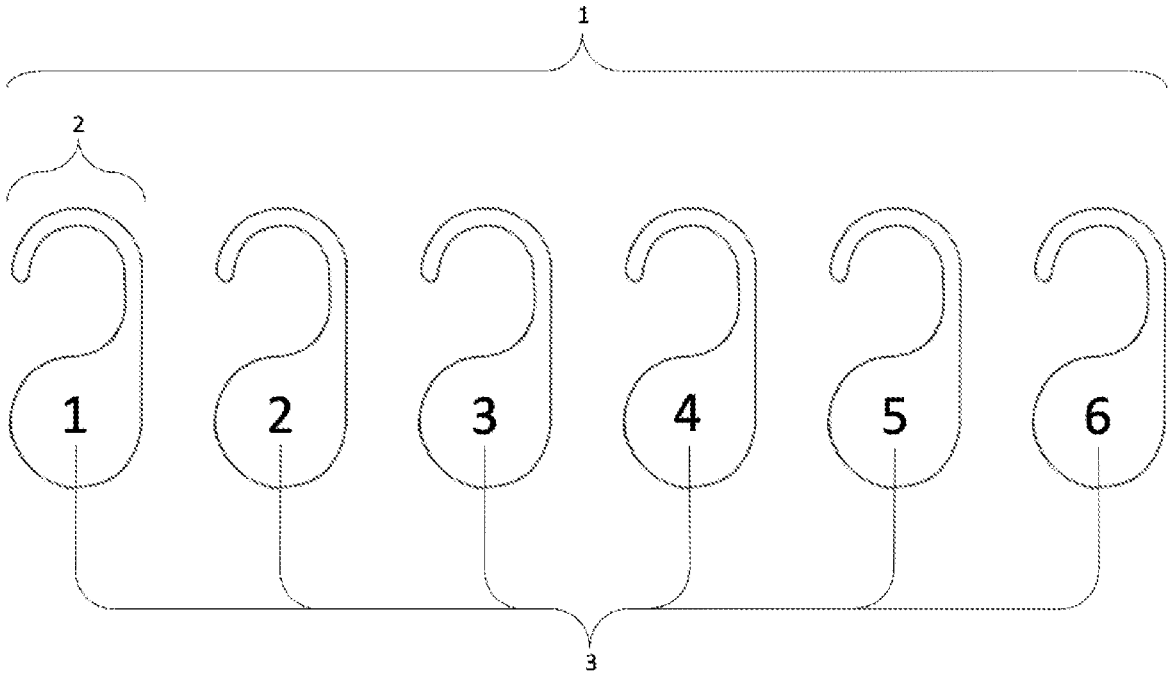
FIG. 1 depicts a front side view of a set of the hanging numbered clothing wear counting dividers arranged next to each other.

Referring to FIG. 1, an illustrative example of a front side view of a set of the hanging numbered clothing wear counting dividers (1), is provided. This depiction identifies the individual hanging numbered clothing wear counting dividers (2) that comprise the set. This depiction identifies an illustration of the sequential numbering (3) that is featured on each of the respective individual hanging numbered clothing wear counting dividers (2), in this instance with the sequential numbers one through six. The number of individual hanging numbered clothing wear counting dividers (2) that a set of hanging numbered clothing wear counting dividers (1) includes may vary.

Figure 2:
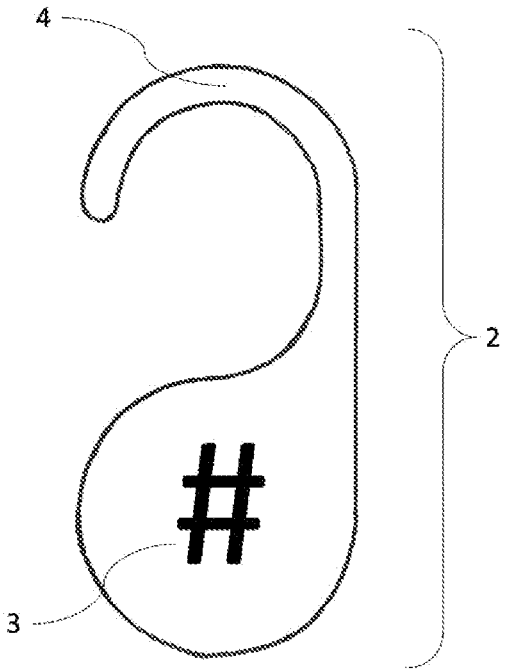
FIG. 2 depicts an exploded front side view of an individual hanging numbered clothing wear counting divider.

Referring to FIG. 2, an illustrative example of an exploded front side view of an individual hanging numbered clothing wear counting divider (2), is provided. This depiction identifies an illustration of the sequential numbering (3) that is featured on each of the individual hanging numbered clothing wear counting dividers (2), in this instance with a "#" symbol as a placeholder. This depiction identifies an illustration of the hook-like shape configuration (4) featured on each of the individual hanging numbered clothing wear counting dividers (2). The hook-like shape configuration enables the dividers to be placed on closet hanger poles where hanging articles of clothing are placed.

Figure 3:
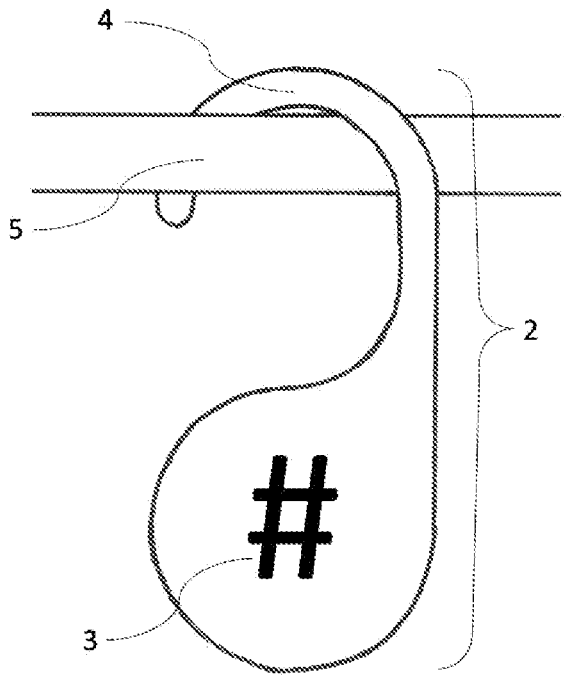
FIG. 3 depicts an exploded perspective view of an individual hanging numbered clothing wear counting divider placed on a closet hanger pole.

Referring to FIG. 3, an illustrative example of an exploded perspective view of an individual hanging numbered clothing wear counting divider (2) placed on a closet hanger pole (5), is provided. This depiction identifies the hook-like shape configuration (4) which is depicted to be hanging on a closet hanger pole (5). The hook-like shape configuration enables the dividers to be placed on closet hanger poles where hanging articles of clothing are placed. This depiction identifies an illustration of the sequential numbering (3) that is featured on each of the individual hanging numbered clothing wear counting dividers (2), in this instance with a "#" symbol as a placeholder for the sequential numbers.

Figure 4:
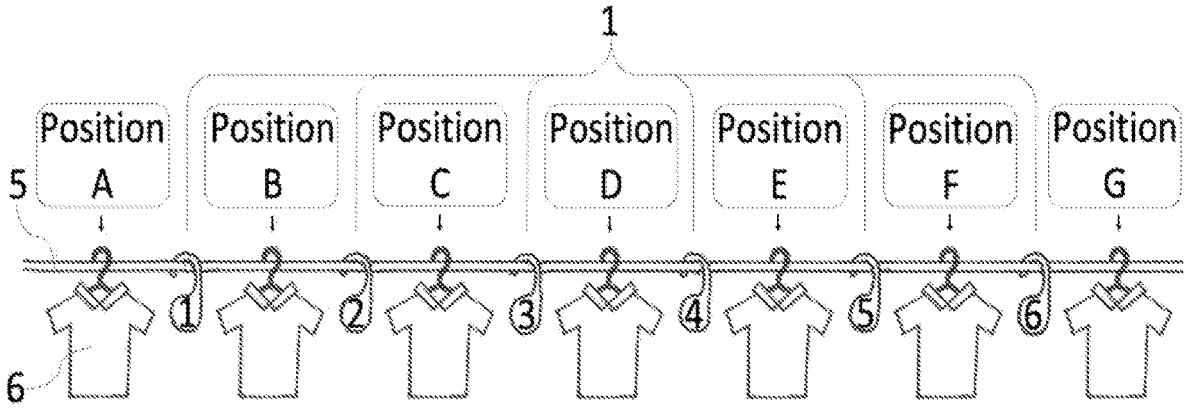
FIG. 4 depicts a perspective view of a set of the hanging numbered clothing wear counting dividers arranged in sequential order on a closet hanger pole identifying the positions partitioned by the individual hanging numbered clothing wear counting dividers.

Referring to FIG. 4, an illustrative example of a perspective view of a set of the hanging numbered clothing wear counting dividers (1) arranged in sequential order on a closet hanger pole (5) with hanging articles of clothing (6) selectively placed in the positions partitioned by the hanging numbered clothing wear counting dividers (1), is provided. This depiction identifies the positions partitioned by the hanging numbered clothing wear counting dividers that indicate the number of times the respective hanging articles of clothing have been worn. In this illustration, the partitioned positions are designated with the alphabetical letters A through G.

Position A is the position partitioned for hanging articles of clothing that have not been worn. Position A is located on the exterior of the sequentially arranged set of hanging numbered clothing wear counting dividers before the individual hanging numbered clothing wear counting divider sequentially numbered 1. If a hanging article of clothing has not been worn, it should be selectively placed in position A.

Position B is the position partitioned for hanging articles of clothing that have been worn one time. Position B is located between the individual hanging numbered clothing wear counting divider sequentially numbered 1 and the individual hanging numbered clothing wear counting divider sequentially numbered 2. If a hanging article of clothing has been worn one time, it should be selectively placed in position B.

Position C is the position partitioned for hanging articles of clothing that have been worn two times. Position C is located between the individual hanging numbered clothing wear counting divider sequentially numbered 2 and the individual hanging numbered clothing wear counting divider sequentially numbered 3. If a hanging article of clothing has been worn two times, it should be selectively placed in position C.

Position D is the position partitioned for hanging articles of clothing that have been worn three times. Position D is located between the individual hanging numbered clothing wear counting divider sequentially numbered 3 and the individual hanging numbered clothing wear counting divider sequentially numbered 4. If a hanging article of clothing has been worn three times, it should be selectively placed in position D.

Position E is the position partitioned for hanging articles of clothing that have been worn four times. Position E is located between the individual hanging numbered clothing wear counting divider sequentially numbered 4 and the individual hanging numbered clothing wear counting divider sequentially numbered 5. If a hanging article of clothing has been worn four times, it should be selectively placed in position E.

Position F is the position partitioned for hanging articles of clothing that have been worn five times. Position F is located between the individual hanging numbered clothing wear counting divider sequentially numbered 5 and the individual hanging numbered clothing wear counting divider sequentially numbered 6. If a hanging article of clothing has been worn five times, it should be selectively placed in position F.

Position G is the position partitioned for hanging articles of clothing that have been worn six or more times. Position G is located on the exterior of the set of hanging numbered clothing wear counting dividers after the individual hanging numbered clothing wear counting divider sequentially numbered 6. If a hanging article of clothing has been worn six or more times, it should be selectively placed in position G.

Referring to FIG. 5, a flowchart illustration that shows the method that keeps count of the number of times hanging articles of clothing have been worn with the hanging numbered clothing wear counting dividers, is provided. The flowchart illustration references the positions partitioned by the hanging numbered clothing wear counting dividers that indicate the number of times the respective hanging articles of clothing have been worn according to FIG. 4.

The present flowchart illustration shows the circular method that hanging articles of clothing undertake when using the hanging numbered clothing wear counting dividers. The method starts at the top left location at an activity rectangle stating "Position A" which denotes the hanging article of clothing should be selectively placed in position A. Position A, relating to the position that was established by FIG. 4, indicates the hanging articles of clothing have not been worn. The method then depicts an arrow which leads to an activity rectangle stating "Wear" which denotes that after being in position A, the hanging article of clothing is worn. The method then depicts an arrow which leads to a decision diamond asking "Question 1: Wear again?" which denotes that a "Yes" or "No" response must be given. A response of "Yes" denotes that the hanging article of clothing will be placed in a new partitioned positioned on the closest hanger pole and can be worn again. A response of "No" denotes that the hanging article of clothing will not be worn again and will instead be cleaned.

If a "No" response is given to "Question 1: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 1: Wear again?", the method then depicts an arrow which leads to an activity rectangle stating "Position B" which denotes the hanging article of clothing should be selectively placed in position B. Position B, relating to the position that was established by FIG. 4, indicates the hanging articles of clothing have been worn one time. The method then depicts an arrow which leads to an activity rectangle stating "Wear" which denotes that after being in position B, the hanging article of clothing is worn. The method then depicts an arrow which leads to a decision diamond asking "Question 2: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 2: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 2: Wear again?", the method then depicts an arrow which leads to an activity rectangle stating "Position C" which denotes the hanging article of clothing should be selectively placed in position C. Position C, relating to the position that was established by FIG. 4, indicates the hanging articles of clothing have been worn two times. The method then depicts an arrow which leads to an activity rectangle stating "Wear" which denotes that after being in position C, the hanging article of clothing is worn. The method then depicts an arrow which leads to a decision diamond asking "Question 3: Wear again?" which denotes that a "Yes" or "No" response must be given. A response of "Yes" denotes that the hanging article of clothing will be placed in a new partitioned positioned on the closest hanger pole and can be worn again. A response of "No" denotes that the hanging article of clothing will not be worn again and will instead be cleaned.

If a "No" response is given to "Question 3: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 3: Wear again?", the method then depicts an arrow which leads to an activity rectangle stating "Position D" which denotes the hanging article of clothing should be selectively placed in position D. Position D, relating to the position that was established by FIG. 4, indicates the hanging articles of clothing have been worn three times. The method then depicts an arrow which leads to an activity rectangle stating "Wear" which denotes that after being in position D, the hanging article of clothing is worn. The method then depicts an arrow which leads to a decision diamond asking "Question 4: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 4: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 4: Wear again?", the method then depicts an arrow which leads to an activity rectangle stating "Position E" which denotes the hanging article of clothing should be selectively placed in position E. Position E, relating to the position that was established by FIG. 4, indicates the hanging articles of clothing have been worn four times. The method then depicts an arrow which leads to an activity rectangle stating "Wear" which denotes that after being in position E, the hanging article of clothing is worn. The method then depicts an arrow which leads to a decision diamond asking "Question 5: Wear again?" which denotes that a "Yes" or "No" response must be given. A response of "Yes" denotes that the hanging article of clothing will be placed in a new partitioned positioned on the closest hanger pole and can be worn again. A response of "No" denotes that the hanging article of clothing will not be worn again and will instead be cleaned.

If a "No" response is given to "Question 5: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 5: Wear again?", the method then depicts an arrow which leads to an activity rectangle stating "Position F" which denotes the hanging article of clothing should be selectively placed in position F. Position F, relating to the position that was established by FIG. 4, indicates the hanging articles of clothing have been worn five times. The method then depicts an arrow which leads to an activity rectangle stating "Wear" which denotes that after being in position F, the hanging article of clothing is worn. The method then depicts an arrow which leads to a decision diamond asking "Question 6: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 6: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 6: Wear again?", the method then depicts an arrow which leads to an activity rectangle stating "Position G" which denotes the hanging article of clothing should be selectively placed in position G. Position G, relating to the position that was established by FIG. 4, indicates the hanging articles of clothing have been worn six or more times. The method then depicts an arrow which leads back to the previously discussed activity rectangle stating "Wear" which denotes that after being in position G, the hanging article of clothing is worn. The method then depicts an arrow which leads back to the previously discussed decision diamond asking "Question 6: Wear again?" which denotes that a "Yes" or "No" response must be given again. A response of "Yes" denotes that the hanging article of clothing will be placed back to its previous partitioned position on the closet hanger pole and can be worn again. A response of "No" denotes that the hanging article of clothing will not be worn again and will instead be cleaned.

If a "No" response is given to "Question 6: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

If a "Yes" response is given to "Question 6: Wear again?", the method then depicts an arrow which leads back to the previously discussed activity rectangle stating "Position G" which denotes the hanging article of clothing should be selectively placed in position G. The method will continuously direct back to position G, or the position partitioned by the highest sequentially numbered divider, until a "No" response is given to "Question 6: Wear again?" When a "No" response is given to "Question 6: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A". At this point, a cycle within the method has been completed and the method can be restarted and repeated indefinitely.

Referring to FIG. 6, a visual depiction of the flowchart illustration according to FIG. 5, which shows the method that keeps count of the number of times hanging articles of clothing (6) have been worn with the hanging numbered clothing wear counting dividers (1), is provided. The visual depiction includes an illustrative example of a perspective view of a set of the hanging numbered clothing wear counting dividers (1) arranged in sequential order on a closet hanger pole (5) with hanging articles of clothing (6) selectively placed in the positions partitioned by the hanging numbered clothing wear counting dividers (1). The visual depiction identifies the positions partitioned by the hanging numbered clothing wear counting dividers that indicate the number of times the respective hanging articles of clothing have been worn according to FIG. 4. The flowcharts in FIG. 5 and FIG. 6 both reference and address the same positions (Positions A through G) and questions (Questions 1 through 6). The visual depiction of the flowchart illustration demonstrates the fluid movement that hanging articles of clothing undergo during the method.

The present visual depiction of the flowchart illustration shows the circular method that hanging articles of clothing undertake when using the hanging numbered clothing wear counting dividers. The method starts at "Position A" on the left side of the illustration of the closet hanger pole (5) which denotes the hanging article of clothing should be selectively placed in position A. Position A, relating to the position that was established by FIG. 4, indicates the hanging articles of clothing have not been worn. The method then depicts an arrow which leads to an activity rectangle stating "Wear" which denotes that after being in position A, the hanging article of clothing is worn. The method then depicts an arrow which leads to a decision diamond asking "Question 1: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 1: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 1: Wear again?", the method then depicts an arrow which leads to "Position B" on the closet hanger pole (5) which denotes the hanging article of clothing should be selectively placed in position B. Position B, relating to the position that was established by FIG. 4, indicates the hanging articles of clothing have been worn one time. The method then depicts an arrow which leads to an activity rectangle stating "Wear" which denotes that after being in position B, the hanging article of clothing is worn. The method then depicts an arrow which leads to a decision diamond asking "Question 2: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 2: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 2: Wear again?", the method then depicts an arrow which leads to "Position C" on the closet hanger pole (5) which denotes the hanging article of clothing should be selectively placed in position C.

Position C, relating to the position that was established by FIG. 4, indicates the hanging articles of clothing have been worn two times. The method then depicts an arrow which leads to an activity rectangle stating "Wear" which denotes that after being in position C, the hanging article of clothing is worn. The method then depicts an arrow which leads to a decision diamond asking "Question 3: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 3: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 3: Wear again?", the method then depicts an arrow which leads to "Position D" on the closet hanger pole (5) which denotes the hanging article of clothing should be selectively placed in position D. Position D, relating to the position that was established by FIG. 4, indicates the hanging articles of clothing have been worn three times. The method then depicts an arrow which leads to an activity rectangle stating "Wear" which denotes that after being in position D, the hanging article of clothing is worn. The method then depicts an arrow which leads to a decision diamond asking "Question 4: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 4: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 4: Wear again?", the method then depicts an arrow which leads to "Position E" on the closet hanger pole (5) which denotes the hanging article of clothing should be selectively placed in position E. Position E, relating to the position that was established by FIG. 4, indicates the hanging articles of clothing have been worn four times. The method then depicts an arrow which leads to an activity rectangle stating "Wear" which denotes that after being in position E, the hanging article of clothing is worn. The method then depicts an arrow which leads to a decision diamond asking "Question 5: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 5: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 5: Wear again?", the method then depicts an arrow which leads to "Position F" on the closet hanger pole (5) which denotes the hanging article of clothing should be selectively placed in position F. Position F, relating to the position that was established by FIG. 4, indicates the hanging articles of clothing have been worn five times. The method then depicts an arrow which leads to an activity rectangle stating "Wear" which denotes that after being in position F, the hanging article of clothing is worn. The method then depicts an arrow which leads to a decision diamond asking "Question 6: Wear again?" which denotes that a "Yes" or "No" response must be given. A response of "Yes" denotes that the hanging article of clothing will be placed in a new partitioned position on the closet hanger pole and can be worn again. A response of "No" denotes that the hanging article of clothing will not be worn again and will instead be cleaned.

If a "No" response is given to "Question 6: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 6: Wear again?", the method then depicts an arrow which leads to "Position G" on the closet hanger pole (5) which denotes the hanging article of clothing should be selectively placed in position G. Position G, relating to the position that was established by FIG. 4, indicates the hanging articles of clothing have been worn six or more times. The method then depicts an arrow which leads back to the previously discussed activity rectangle stating "Wear" which denotes that after being in position G, the hanging article of clothing is worn. The method then depicts an arrow which leads back to the previously discussed decision diamond asking "Question 6: Wear again?" which denotes that a "Yes" or "No" response must be given. A response of "Yes" denotes that the hanging article of clothing will be placed back to its previous partitioned position on the closet hanger pole and can be worn again. A response of "No" denotes that the hanging article of clothing will not be worn again and will instead be cleaned.

If a "No" response is given to "Question 6: Wear again?", the method then depicts an arrow which leads to an activity rectangle stating "Clean" which denotes that the hanging article of clothing will be cleaned. Once the hanging article of clothing is cleaned, the method then depicts an arrow which leads back to "Position A" on the left side of the illustration of the closet hanger pole (5). At this point, a cycle within the method has been completed and the method can be restarted and repeated indefinitely.

If a "Yes" response is given to "Question 6: Wear again?", the method then depicts an arrow which leads back to the previously discussed activity rectangle stating "Position G" which denotes the hanging article of clothing should be selectively placed in position G. The method will continuously direct back to position G, or the position partitioned by the highest sequentially numbered divider, until a "No" response is given to "Question 6: Wear again?" When a "No" response is given to "Question 6: Wear again?", the method then depicts an arrow which leads to an activity rectangle stating "Clean" which denotes that the hanging article of clothing is cleaned. Once the hanging article of clothing is cleaned, the method then depicts an arrow which leads back to the activity rectangle stating "Position A" on the left side of the illustration of the closet hanger pole (5). At this point, a cycle within the method has been completed and the method can be restarted and repeated indefinitely.

Referring to FIG. 7, an illustrative example of a perspective view of numerous hanging articles of clothing (6) selectively placed in partitioned positions by two individual hanging numbered clothing wear counting dividers (2) arranged in sequential order on a closet hanger pole (5), is provided. The illustration displays how the hanging numbered clothing wear counting dividers are able to keep count of the number of times an unlimited number of hanging articles of clothing have been worn simultaneously.

I claim:

1. A method that keeps count of the number of times hanging articles of clothing have been worn with a device;

the device comprising:

a set of multiple dividers;

the dividers featuring a hook-like shape, tie-on nature or ability, or attachable configuration that enables the dividers to be attached to closet hanger poles where the hanging articles of clothing are placed; and the dividers featuring sequential numbering;

the method comprising:

selectively placing the hanging articles of clothing in positions partitioned by the dividers that indicate the variable and changing number of times the respective hanging articles of clothing have been worn in a manner that allows for multiple hanging articles of clothing to be counted simultaneously, as part of a repeatable process.

* * * * *